US008632440B2

(12) United States Patent
Pratson et al.

(10) Patent No.: US 8,632,440 B2
(45) Date of Patent: Jan. 21, 2014

(54) PROPRIOCEPTION TRAINING AND EXERCISE DEVICE

(75) Inventors: David C. Pratson, Bonsall, CA (US); Tien Le, Oceanside, CA (US); John Cole, Encinitas, CA (US); Irene Elisa Mnich, Oceanside, CA (US)

(73) Assignee: iStep Global, LLC, Encinitas, CA (US)

( * ) Notice: Subject to any disclaimer, the term of this patent is extended or adjusted under 35 U.S.C. 154(b) by 260 days.

(21) Appl. No.: 12/632,691

(22) Filed: Dec. 7, 2009

(65) Prior Publication Data

US 2010/0087300 A1 Apr. 8, 2010

Related U.S. Application Data

(63) Continuation-in-part of application No. 12/075,322, filed on Mar. 10, 2008, now Pat. No. 7,722,506.

(60) Provisional application No. 60/905,969, filed on Mar. 10, 2007.

(51) Int. Cl.
*A63B 22/04* (2006.01)

(52) U.S. Cl.
USPC ..... 482/52; 273/458

(58) Field of Classification Search
USPC ..... 482/26, 27, 51, 52, 77, 112, 127, 128, 482/135, 137, 140, 142, 145, 146, 148; 441/131; 601/23; 273/449, 457, 458
See application file for complete search history.

(56) References Cited

U.S. PATENT DOCUMENTS

| | | | | |
|---|---|---|---|---|
| 2,761,155 | A | 9/1956 | Headley | |
| 3,095,947 | A | 5/1960 | Beaulaurier | |
| 2,978,243 | A * | 4/1961 | Gabrielson | 472/14 |
| 3,167,312 | A * | 1/1965 | Blanchard | 482/128 |
| 3,125,377 | A | 2/1974 | Buchner et al. | |
| 4,021,873 | A * | 5/1977 | Francois | 114/345 |
| 4,159,826 | A | 7/1979 | Hancock | |
| 4,516,767 | A | 5/1985 | Eskijian | |
| 4,516,768 | A * | 5/1985 | Gallaro | 482/26 |
| 4,817,950 | A * | 4/1989 | Goo | 463/36 |
| 5,112,045 | A * | 5/1992 | Mason et al. | 482/9 |
| 5,297,978 | A * | 3/1994 | Ramsey | 441/131 |
| 5,441,466 | A * | 8/1995 | Piaget et al. | 482/52 |
| 5,575,738 | A | 11/1996 | Millington et al. | |
| 5,637,057 | A | 6/1997 | Collura | |

(Continued)

FOREIGN PATENT DOCUMENTS

| | | |
|---|---|---|
| JP | 2005-507291 | 3/2005 |
| JP | 2006-095132 | 4/2006 |
| WO | 03/037445 | 5/2003 |
| WO | 2005/057620 | 6/2005 |

*Primary Examiner* — Stephen Crow

(74) *Attorney, Agent, or Firm* — Charles F. Reidelbach, Jr.

(57) ABSTRACT

An exercise apparatus includes a substantially flat, rigid platform for supporting a person's weight. A first inflatable tubular support includes a fastener for clamping the platform to a top surface of the first tubular support. A second inflatable tubular support includes a fastener for fastening a top surface of the second inflatable tubular support to a bottom surface of the first inflatable tubular support. The first inflatable tubular support is inflatable to a first inflation pressure and the second inflatable tubular support is inflatable to a second inflation pressure separately and independently from the first inflation pressure to effect a vertical instability and a horizontal instability of the rigid platform relative to a support surface under the second tubular support.

15 Claims, 15 Drawing Sheets

(56) References Cited

U.S. PATENT DOCUMENTS

| | | | | |
|---|---|---|---|---|
| 5,813,946 | A | 9/1998 | Lin et al. | |
| 6,015,471 | A | 1/2000 | Rimington et al. | |
| 6,024,678 | A * | 2/2000 | Solomon | 482/111 |
| 6,422,983 | B1 | 7/2002 | Weck | |
| 6,554,753 | B1 | 4/2003 | Weck et al. | |
| 6,575,885 | B1 | 6/2003 | Weck et al. | |
| 6,659,914 | B2 * | 12/2003 | Plante | 482/27 |
| D489,423 | S | 5/2004 | Fan et al. | |
| 7,160,229 | B2 * | 1/2007 | Park | 482/52 |
| 7,344,487 | B2 | 3/2008 | Carter et al. | |
| 7,344,488 | B2 | 3/2008 | Weck et al. | |
| 7,382,332 | B2 * | 6/2008 | Essig et al. | 343/878 |
| 7,468,025 | B2 | 12/2008 | Hauser et al. | |
| 7,494,446 | B2 * | 2/2009 | Weck et al. | 482/47 |
| 7,553,267 | B1 | 6/2009 | Hauser et al. | |
| 7,601,107 | B2 * | 10/2009 | Maloy et al. | 482/123 |
| 7,722,506 | B2 * | 5/2010 | Pratson et al. | 482/52 |
| D627,015 | S * | 11/2010 | Senegal | D21/689 |
| 2004/0023766 | A1 * | 2/2004 | Slone | 482/146 |
| 2004/0110609 | A1 | 6/2004 | Huang | |
| 2005/0009677 | A1 * | 1/2005 | Yang | 482/142 |
| 2005/0049123 | A1 * | 3/2005 | Dalebout et al. | 482/142 |
| 2005/0148433 | A1 | 7/2005 | Wang et al. | |
| 2005/0227838 | A1 * | 10/2005 | Friesen | 482/148 |

* cited by examiner

PROPRIOCEPTION TRAINING AND EXERCISE DEVICE

CROSS-REFERENCE TO RELATED APPLICATIONS

This application is a continuation-in-part of pending U.S. patent application Ser. No. 12/075,322, filed on Mar. 10, 2008, which claims the benefit of U.S. Provisional Application Ser. No. 60/905,969, filed on Mar. 10, 2007, and which are incorporated herein by reference.

BACKGROUND OF THE INVENTION

1. Field of the Invention

The present invention is directed generally to exercise equipment. More specifically, but without limitation thereto, the present invention is directed to a device for exercise and for proprioception training.

2. Description of Related Art

Proprioception is the sense of the relative position of neighboring parts of the body. Unlike the six exteroceptive senses (sight, taste, smell, touch, hearing, and balance) by which we perceive the outside world, and interoceptive senses, by which we perceive the pain and movement of internal organs, proprioception is a third distinct sensory modality that indicates whether the body is moving with sufficient effort, as well as where the various parts of the body are located in relation to one another. A variety of devices have been developed for proprioception training for athletes and for rehabilitating patients recovering from injuries that affect movement and coordination.

SUMMARY OF THE INVENTION

In one embodiment, an exercise apparatus includes a substantially flat, rigid platform for supporting a person's weight. A first inflatable tubular support includes a fastener for clamping the platform to a top surface of the first tubular support. A second inflatable tubular support includes a fastener for fastening a top surface of the second inflatable tubular support to a bottom surface of the first inflatable tubular support. The first inflatable tubular support is inflatable to a first inflation pressure and the second inflatable tubular support is inflatable to a second inflation pressure separately and independently from the first inflation pressure to effect a vertical instability and a horizontal instability of the rigid platform relative to a support surface under the second tubular support.

BRIEF DESCRIPTION OF THE DRAWINGS

The above and other aspects, features and advantages will become more apparent from the description in conjunction with the following drawings presented by way of example and not limitation, wherein identical reference indicia in separate views indicate the same elements and the same combinations of elements throughout the drawings, and wherein.

Elements in the figures are illustrated for simplicity and clarity and have not necessarily been drawn to scale. For example, the dimensions of some elements in the figures may be exaggerated relative to other elements, and some elements and features of some elements may be omitted in certain views to facilitate illustration and explanation of various embodiments within the scope of the appended claims. Accordingly, indicia that reference a specific element or a specific combination of elements in any view explicitly include by reference all the features shown for that element or combination of elements referenced by the same indicia in all the views.

DETAILED DESCRIPTION OF THE ILLUSTRATED EMBODIMENTS

The following description is not to be taken in a limiting sense, rather for the purpose of describing by specific examples the general principles that are incorporated into the illustrated embodiments. For example, certain actions or steps may be described or depicted by way of example to be performed in a specific order without excluding performing the described steps in another order or arrangement to achieve substantially the same result. Also, the terms and expressions used in the description have the ordinary meanings accorded to such terms and expressions in the corresponding respective areas of inquiry and study except where other meanings have been specifically set forth herein.

The proprioceptive sense may be improved through exercises for athletes as well as for injured people undergoing rehabilitation. For example, juggling trains the mind for reaction time, spatial location, and efficient movement, and standing on a wobbly board or a balance board can re-train or increase proprioception abilities, especially as physical therapy for ankle or knee injuries. Accordingly, an exercise or balance device is desirable that has both a cushioning effect during step exercising and an elevated substantially rigid platform that responds to the user's weight with unanticipated lateral and vertical movement for proprioceptive input training In addition, multiple exercise devices may be used in competition to play balance games.

An elastic resistance band is a portable alternative to weights for strength training Several resistance band exercises have been devised to target specific muscle groups. Resistance band exercises are widely used by health and fitness practitioners for improving strength, conditioning, rehabilitation, and injury prevention. Disadvantageously, previous resistance band devices are typically connected by a heavy mount to the wall or floor, or they are held by the user's foot while in use, which may cause problems or injuries if it slips during an exercise. Accordingly, a step exerciser is desirable that provides a step aerobic device with an elastic resistance band that may be used in combination to improve or rehabilitate proprioception.

Figure 1:
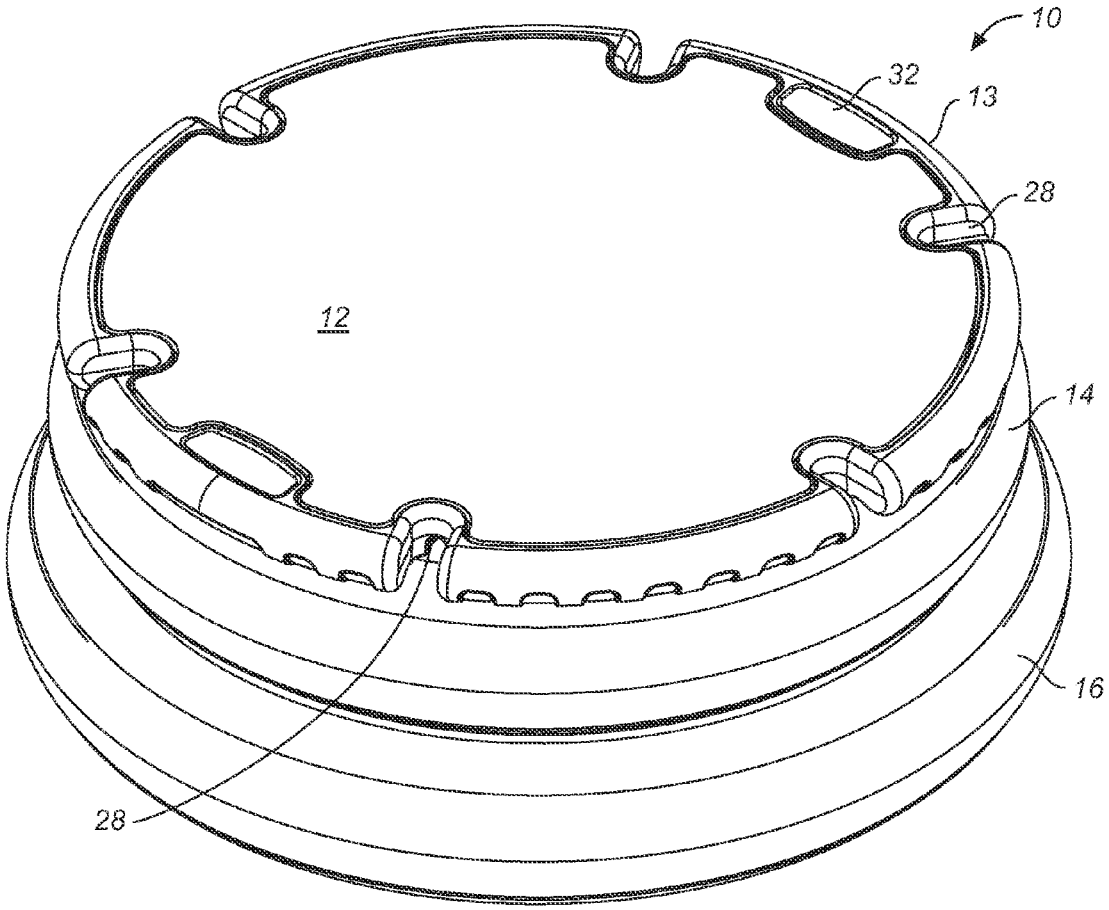
FIG. 1 illustrates a perspective view of an exercise device with a flat, rigid platform supported on an upper tubular support and a lower tubular support.

FIG. 1 illustrates a perspective view of an exercise device 10 with a flat, rigid platform supported on an upper tubular support and a lower tubular support. Shown in FIG. 1 are a rigid platform 12, a platform support 13, an upper tubular support 14, a lower tubular support 16, accessory mounts 28, and lift handles 32.

In FIG. 1, the rigid platform 12 may be made of, for example, wood, plastic, or metal to support a user's weight without deforming. The rigid platform 12 is supported by the platform support 13, which may be made of, for example, the same material as the rigid platform 12. In one embodiment, the platform support 13 includes a rotation mechanism made according to well-known mechanical techniques that allows the user to rotate the rigid platform 12 relative to the floor or support surface below the lower tubular support 16. In another embodiment, the rigid platform 12 is fastened to or integral to the platform support 13 so that the rigid platform 12 does not rotate.

The platform support 13 is fastened according to well-known techniques to the upper tubular support 14. The upper tubular support 14 is fastened according to well-known techniques to the lower tubular support 16. The lift handles 32 provide a convenient grip for carrying the exercise device 10.

Figure 2:
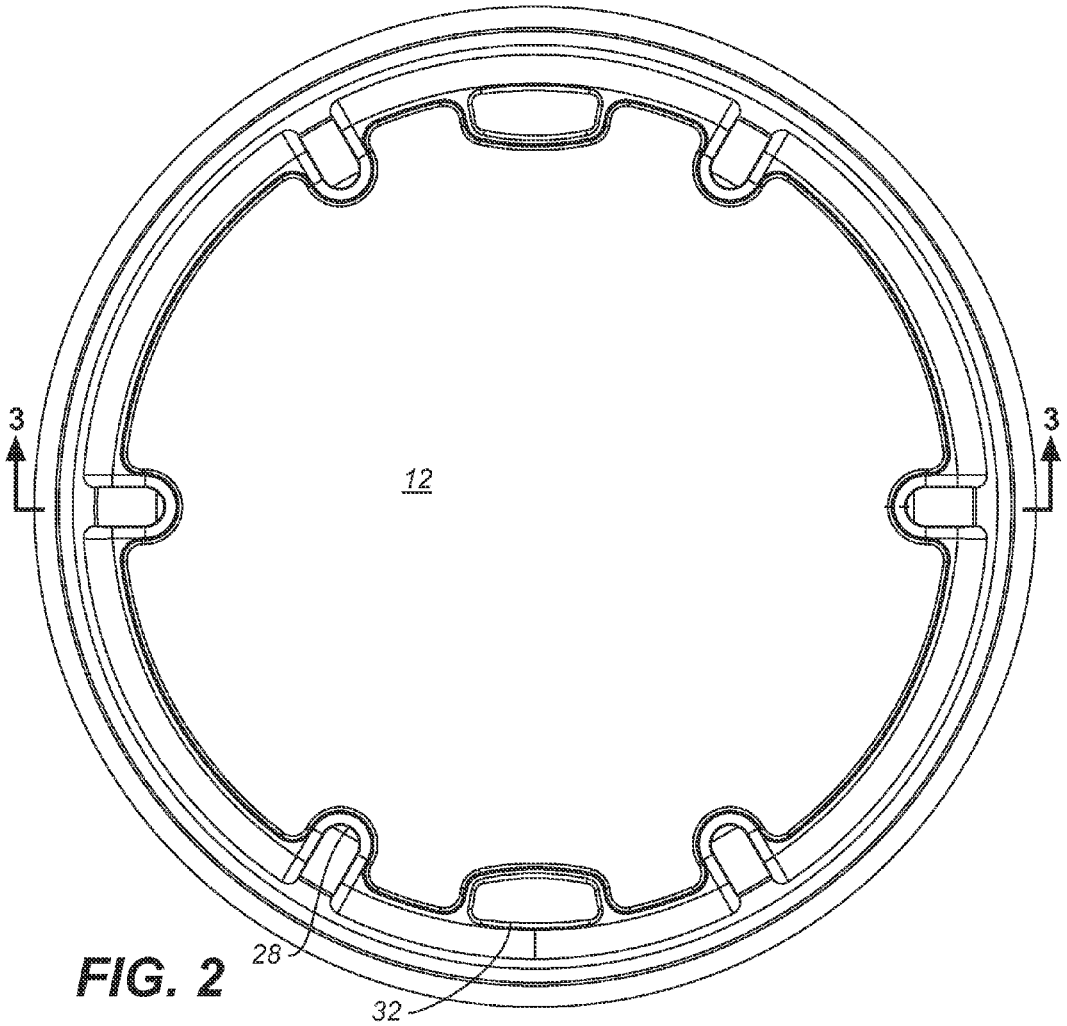
FIG. 2 illustrates a top view of the exercise device of FIG. 1.

FIG. 2 illustrates a top view of the exercise device 10 of FIG. 1. Shown in FIG. 2 are a rigid platform 12, accessory mounts 28, and lift handles 32.

In FIG. 2, the accessory mounts 28 may be, for example, holes along the periphery of the rigid platform 12 for fastening resistance bands and other accessories to the exercise device 10.

Figure 3:
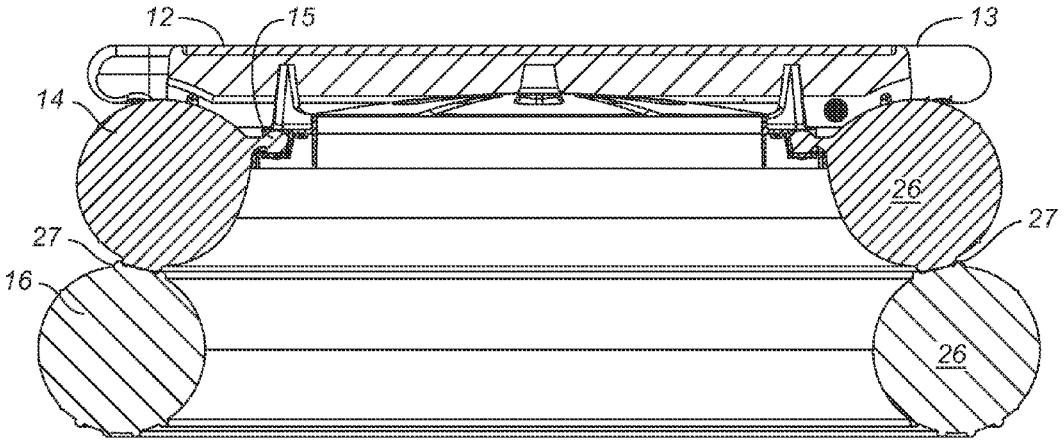
FIG. 3 illustrates a cross-sectional view through FIG. 2 of the exercise device in FIG. 1.

FIG. 3 illustrates a cross-sectional view through FIG. 2 of the exercise device in FIG. 1. Shown in FIG. 3 are a rigid platform 12, a platform support 13, an upper tubular support 14, an annular flange 15, a lower tubular support 16, sealed interior cavities 26, and a tongue and groove fastener 27.

In FIG. 3, the rigid platform 12 is held in an elevated position adjacent to the upper end of a sidewall that includes the upper tubular support 14 and the lower tubular support 16. The upper tubular support 14 and the lower tubular support 16 include the separate, sealed interior cavities 26. In one embodiment, the upper tubular support 14 and the lower tubular support 16 are formed in a circular shape. In other embodiments, the upper tubular support 14 and the lower tubular support 16 are formed in various shapes such as a rectangle or a square according to well-known techniques to suit specific applications within the scope of the appended claims. The sealed interior cavities 26 are each enclosed by an elastic material such as rubber, polypropylene, polyethylene, or other suitable polymers. The upper tubular support 14 and the lower tubular support 16 are independently inflated with air or another suitable fluid to a desired pressure by well-known means and devices for introducing a fluid into a vessel (not shown) such as valve stems commonly used in inner tubes, flush mounted valves commonly used in basketballs and footballs, and so on. In various embodiments, one or both of the upper tubular support 14 and the lower tubular support 16 include a valve stem, a flush mounted valve, or other device for adjusting the inflation pressure of one or both of the upper tubular support 14 and the lower tubular support 16. In other embodiments, the inflation pressure of one or both of the upper tubular support 14 and the lower tubular support 16 is fixed during manufacture and does not include means for adjusting inflation pressure to suit specific applications within the scope of the appended claims.

The capability to select a separate inflation pressure for each of the upper tubular support 14 and the lower tubular support 16 independently provides a means for adjusting the vertical and horizontal instability of the rigid platform 12 in response to the shifting weight of the user on the rigid platform 12 over a range that varies from a barely perceptible movement to a displacement that requires the user to move quickly to maintain balance. For example, the lower tubular support 16 may be inflated to a low pressure that allows the upper tubular support 14 to nest or cradle in the lower tubular support 16. The portion of the lower tubular support 16 that cradles the upper tubular support 14 resists lateral movement of the rigid platform 12, suppressing horizontal instability while providing a cushioning vertical instability. As the inflation pressure is increased in the lower tubular support 16, the horizontal instability of the rigid platform 12 increases to a maximum, then decreases as the inflation pressure causes the lower tubular support 16 to become rigid. Varying the inflation pressure of the upper tubular support 14 has a similar effect on the vertical and horizontal instability of the rigid platform 12. Accordingly, the separate inflation pressures in the upper tubular support 14 and the lower tubular support 16 may be independently selected to provide a wide range of vertical and horizontal instability responses to the user's weight on the rigid platform 12.

The vertical and horizontal instability of the rigid platform 12 results from the compression of the upper tubular support 14 and the lower tubular support 16 in response to the movement of a user on the rigid platform 12. When the user's weight is unevenly balanced from the center of the rigid platform 12, one side of the sidewall formed by the upper tubular support 14 and the lower tubular support 16 is compressed more than the opposite side, resulting in a horizontal displacement of the rigid platform 12 as well as a vertical displacement according to a range of inflation pressures selected for the upper tubular support 14 and the lower tubular support 16. Because the upper tubular support 14 and the lower tubular support 16 have a resilience that depends on their respective inflation pressures, they will react with separate compression rates and roll rates toward the center axis of the device 10 when the user's weight shifts on the platform 12. By inflating one of the upper tubular support 14 and the lower tubular support 16 more than the other, unique unstable configurations may be achieved for balance practice.

In one embodiment, the rigid platform 12 is supported across its planar surface by the underlying platform support 13. In various embodiments, the platform support 13 is made of a substantially rigid material or a compressible material for cushioning. In a further embodiment, the rigid platform 12 and the platform support 13 are integrated or made as a single piece.

Figure 3A:
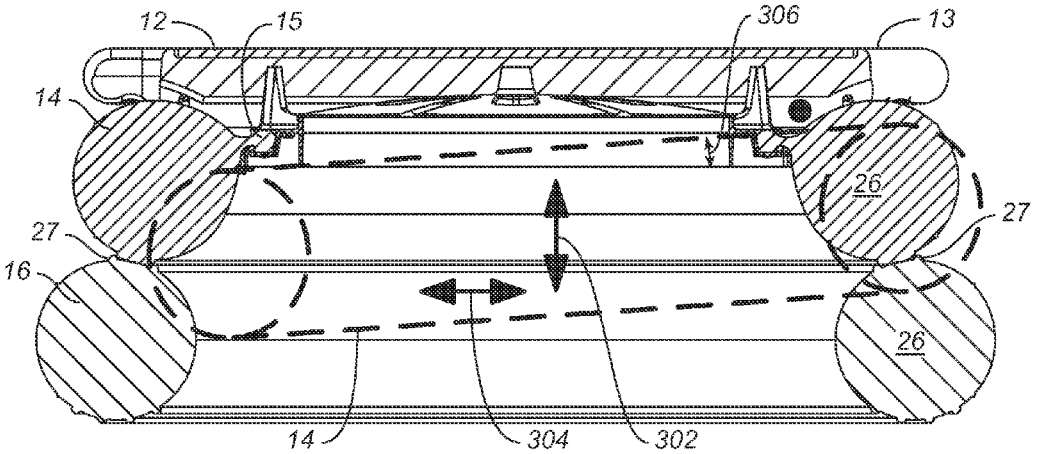
FIG. 3A illustrates a cross-sectional view of the exercise device in FIG. 3 with vertical and horizontal instability.

FIG. 3A illustrates a cross-sectional view of the exercise device in FIG. 3 with vertical and horizontal instability. Shown in FIG. 3A are a rigid platform 12, a platform support 13, an upper tubular support 14, an annular flange 15, a lower tubular support 16, sealed interior cavities 26, a tongue and groove fastener 27, a vertical instability 302, a horizontal instability 304, and a platform angle 306.

In FIG. 3A, the vertical instability 302 and the horizontal instability 304 of the rigid platform 12 results from the compression of the upper tubular support 14 and the lower tubular support 16 in response to the movement of a user on the rigid platform 12. When the user's weight is unevenly balanced from the center of the rigid platform 12, one side of the sidewall formed by the upper tubular support 14 and the lower tubular support 16 is compressed more than the opposite side, resulting in a horizontal displacement of the rigid platform 12 in response to the horizontal instability 304 as well as a vertical displacement in response to the vertical instability 302 in accordance with the respective inflation pressure selected for each of the upper tubular support 14 and the lower tubular support 16. Accordingly, the combination of the horizontal displacement and the vertical displacement of the rigid platform 12 produces a varying tilt angle of the rigid platform 12 in response to a weight shift on the rigid platform 12 relative to the support surface under the second tubular support, such as a floor. The varying tilt angle of the rigid platform 12 provided by the vertical instability 302 and the horizontal instability 304 advantageously enhances the proprioceptive training function of the exercise device 10.

Figure 3B:
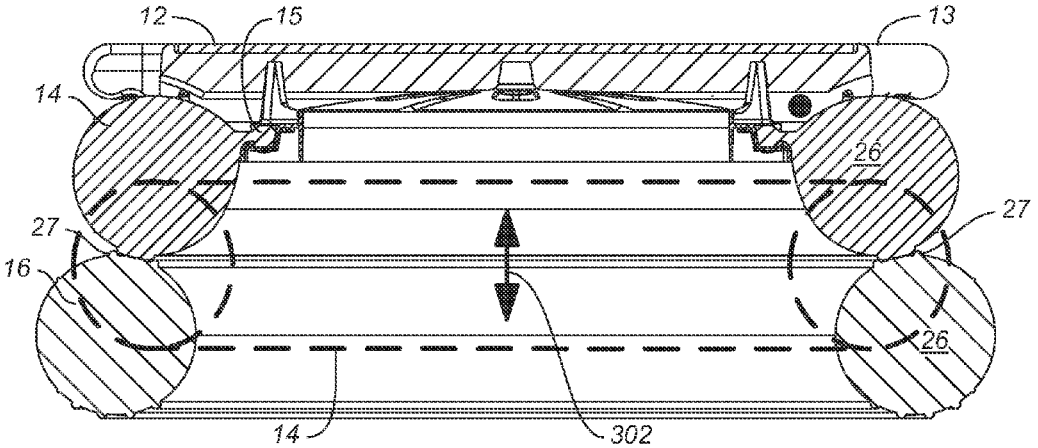
FIG. 3B illustrates the vertical instability with horizontal stability of the exercise device in FIG. 3 when the upper tubular support is cradled in the partially inflated lower tubular support.

FIG. 3B illustrates the vertical instability with horizontal stability of the exercise device in FIG. 3 when the upper tubular support is cradled in the partially inflated lower tubular support. Shown in FIG. 3B are a rigid platform 12, a platform support 13, an upper tubular support 14, an annular flange 15, a lower tubular support 16, sealed interior cavities 26, a tongue and groove fastener 27, and a vertical instability 302.

In FIG. 3B, the vertical instability 302 of the rigid platform 12 results from the compression of the upper tubular support 14 in response to the movement and resulting weight shift of a user on the rigid platform 12. Because the lower tubular support 16 has a low inflation pressure, the upper tubular support 14 is cradled or nested in the lower tubular support 16. As a result, there is little or no horizontal instability. This feature allows the horizontal instability of the exercise device 10 to be suppressed for mild training and rehabilitation exercises. Accordingly, the vertical instability 302 and the horizontal instability 304 are separately selectable according to the separate inflation pressures of the upper tubular support 14 and the lower tubular support 16.

Figure 4:
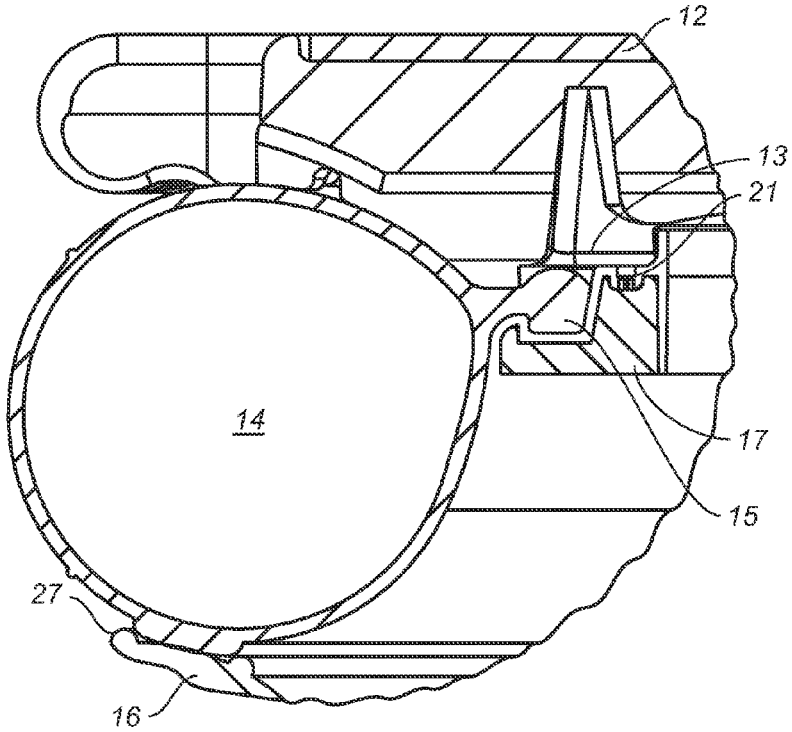
FIG. 4 illustrates a magnified detail view of a fastener to clamp the rigid platform to a top surface of the first tubular support for the exercise device the FIG. 3.

FIG. 4 illustrates a magnified detail view of a fastener to clamp the rigid platform to a top surface of the first tubular support for the exercise device of FIG. 3. Shown in FIG. 4 are a rigid platform 12, a platform support 13, an upper tubular support 14, an annular flange 15, a lower tubular support 16, a fastener ring 17, a snap fastener 21, and a tongue and groove fastener 27.

In one embodiment, the annular flange 15 is a projection formed according to well-known techniques around the inside circumference of the upper tubular member 14. The annular flange 15 is fastened between the bottom surface of the platform support 13 and the fastener ring 17, for example, by a groove formed in the fastener ring 17 that engages the annular flange 15. In one embodiment, the fastener ring 17 snaps into the platform support 13 by the snap fastener 21. In another embodiment, the fastener ring 17 is bolted to the platform support 13. The annular flange 15 holds the platform support 13 and the rigid platform 12 securely against the upper tubular support 14 while allowing the platform support 13 and the rigid platform 12 to move with the upper tubular support 14 in response to the user's shifting weight.

Figure 4A:
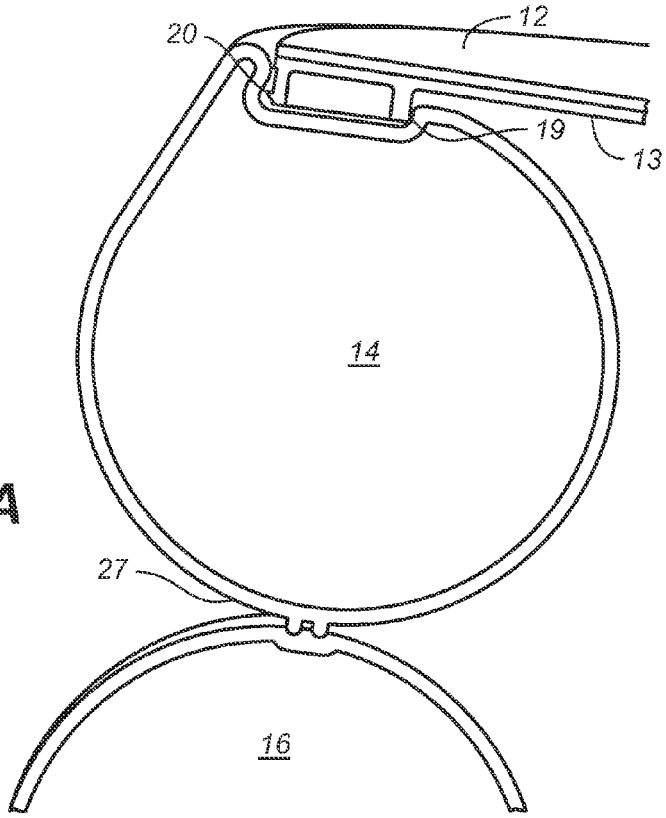
FIG. 4A illustrates a cross-sectional view of an alternative fastener to clamp the rigid platform to a top surface of the first tubular support for the exercise device the FIG. 3.

FIG. 4A illustrates a cross-sectional view of an alternative fastener to clamp the rigid platform to a top surface of the first tubular support for the exercise device the FIG. 3. Shown in FIG. 4A are a rigid platform 12, a platform support 13, an upper tubular support 14, a lower tubular support 16, a fastener projection 19, a platform support recess 20, and a tongue and groove fastener 27.

In FIG. 4A, the fastener projection 19 extends from the outer perimeter of the platform support 13 to engage the platform support recess 20 on the top surface of the upper tubular member 14. In a preferred embodiment, the lower tubular member 16 has a slightly larger diameter than that of the upper tubular member 14. When the user's weight compresses one side of the upper tubular support 14 and the lower tubular support 16, the vertical movement tends to push the upper tubular member 14 toward the center of the exercise device 10. The larger diameter of the lower tubular member 16 also provides a larger footprint on the floor or support surface to prevent slipping. The tongue and groove fastener 27 provides for fastening and separating the upper tubular support 14 and the lower tubular support 16. In another embodiment, the upper tubular support 14 is permanently fastened to the lower tubular support 16 according to well-known techniques, such as glue, etc.

Figure 4B:
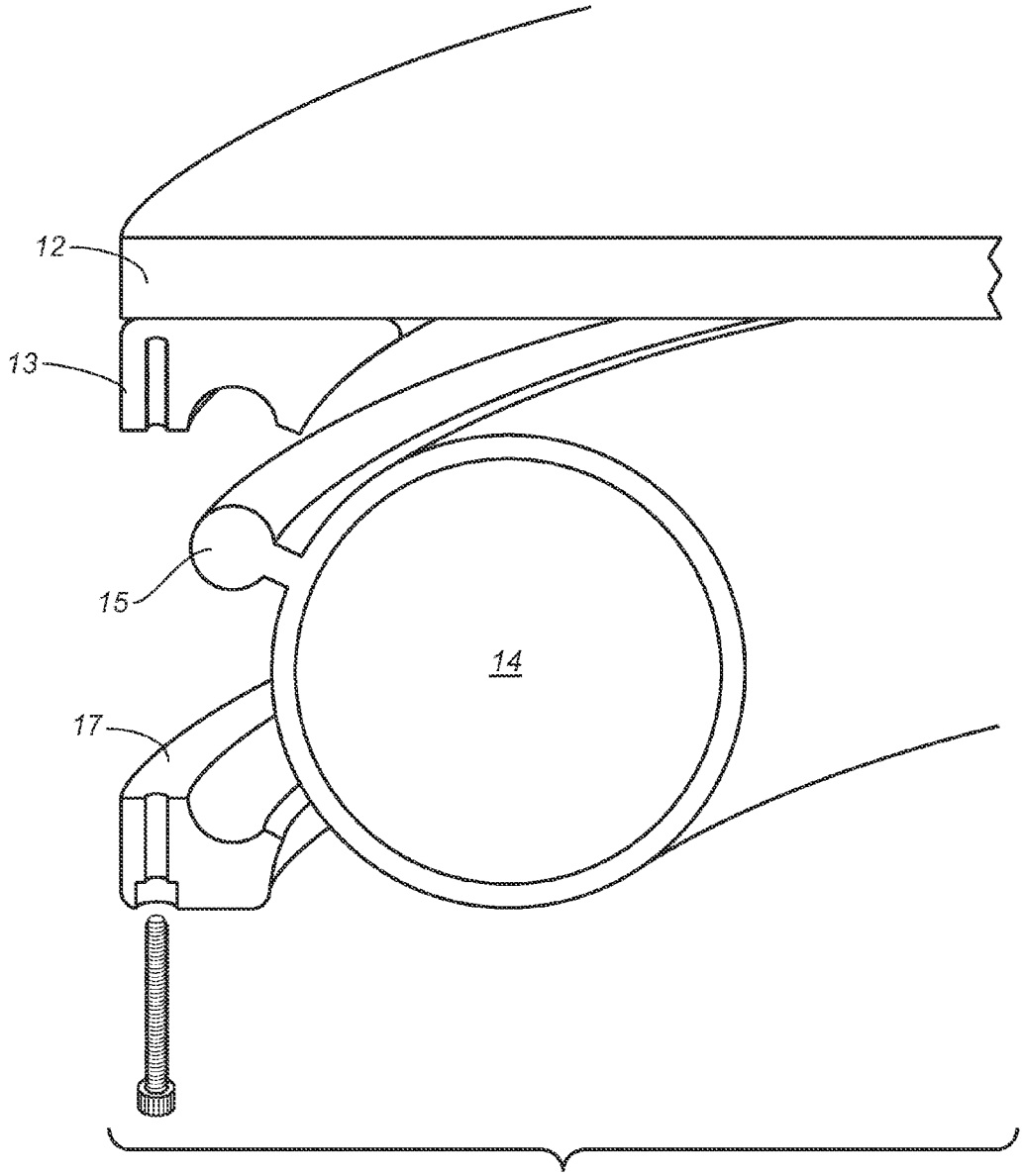
FIG. 4B illustrates an exploded view of a variation of the fastener of FIG. 4.

FIG. 4B illustrates an exploded view of a variation of the fastener of FIG. 4. Shown in FIG. 4B are a rigid platform 12, a platform support 13, an upper tubular support 14, an annular flange 15, and a fastener ring 17.

In FIG. 4B, the annular flange 15 is formed around the circumference of the upper tubular support 14 as in FIG. 3, but on the portion of the upper tubular support 14 that faces outward instead of inward. In one embodiment, the platform support 13 includes a groove that conforms to the top of the annular flange 15, and the fastener ring 17 includes a groove that conforms to the bottom of the annular flange 15. In one embodiment, the fastener ring 17 is bolted to the annular flange 15, clamping the annular flange 15 to the platform support 13. Other devices may be used to fasten the fastener ring 17 to the platform support 13 to clamp the annular flange 15 to the platform support 13 according to well-known techniques to suit specific applications within the scope of the appended claims.

Figure 5:
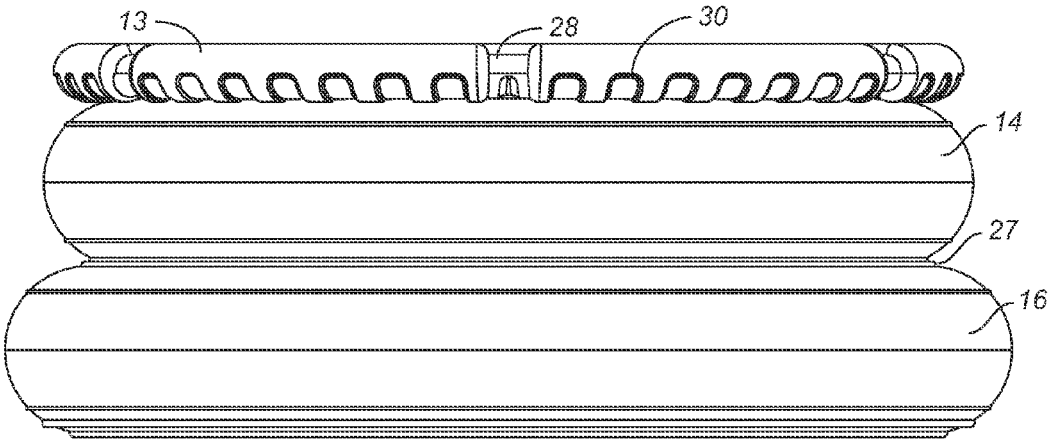
FIG. 5 illustrates a side view of the exercise device of FIG. 1.

FIG. 5 illustrates a side view of the exercise device of FIG. 1. Shown in FIG. 5 are a platform support 13, an upper tubular support 14, a lower tubular support 16, a tongue and groove fastener 27, accessory mounts 28, and air vents 30.

In FIG. 5, the accessory mounts 28 are formed according to well-known techniques in the platform support 13 to attach elastic bands, flexible tension cables, and other exercise equipment. Adjacent to the accessory mounts 28 are the air vents 30 on the outside edge of the platform support 13 that are aimed downward to direct air vented from the central aperture inside the upper tubular support 14 and the lower tubular support 16 away from the user to avoid disturbing the user and to avoid blowing dust or particulate matter into the air.

Figure 6:
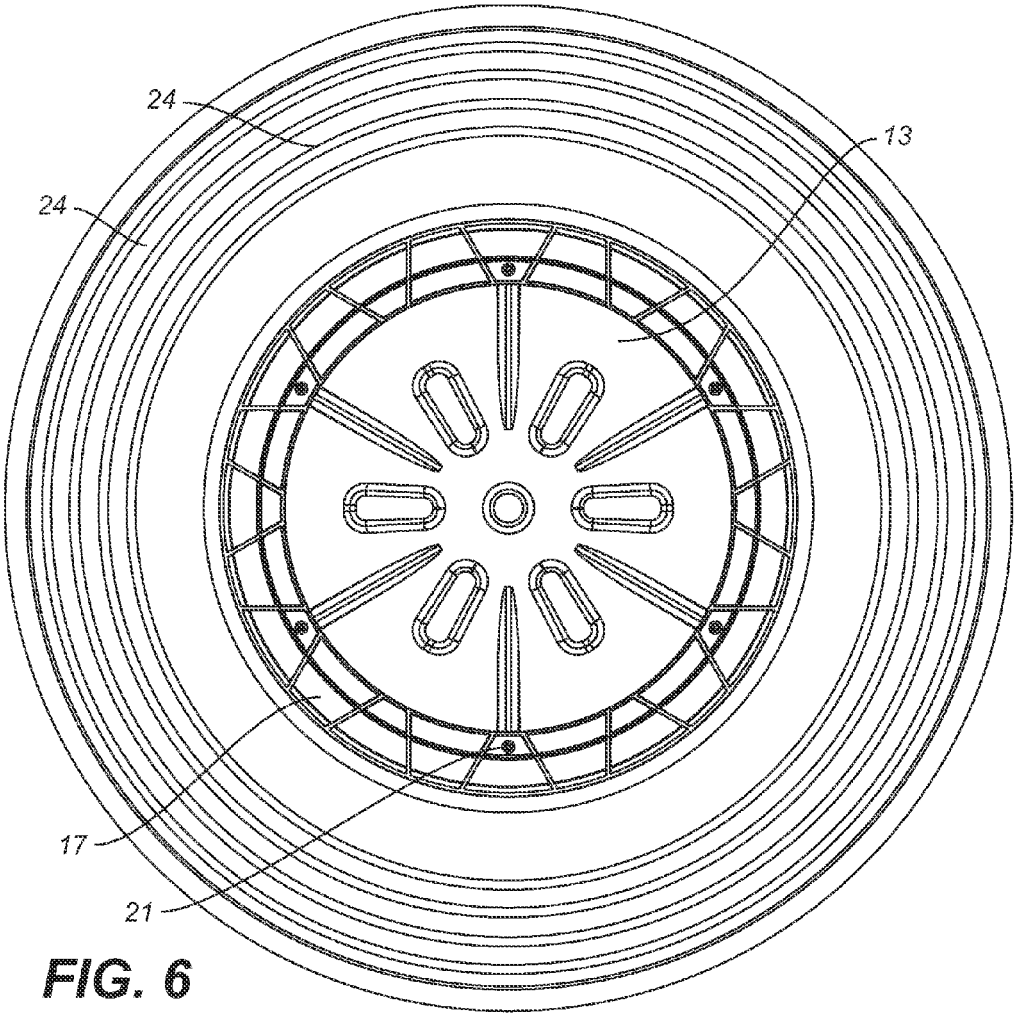
FIG. 6 illustrates a bottom view of the exercise device of FIG. 1.

FIG. 6 illustrates a bottom view of the exercise device of FIG. 1. Shown in FIG. 6 are a platform support 13, a fastener ring 17, a snap fastener 21, and floor grip ridges 24. The floor grip ridges 24 extend from the bottom surface of the lower tubular support 16 to avoid slipping on the floor or other support surface underneath the lower tubular support 16 in both wet and dry surface conditions.

Figure 7:
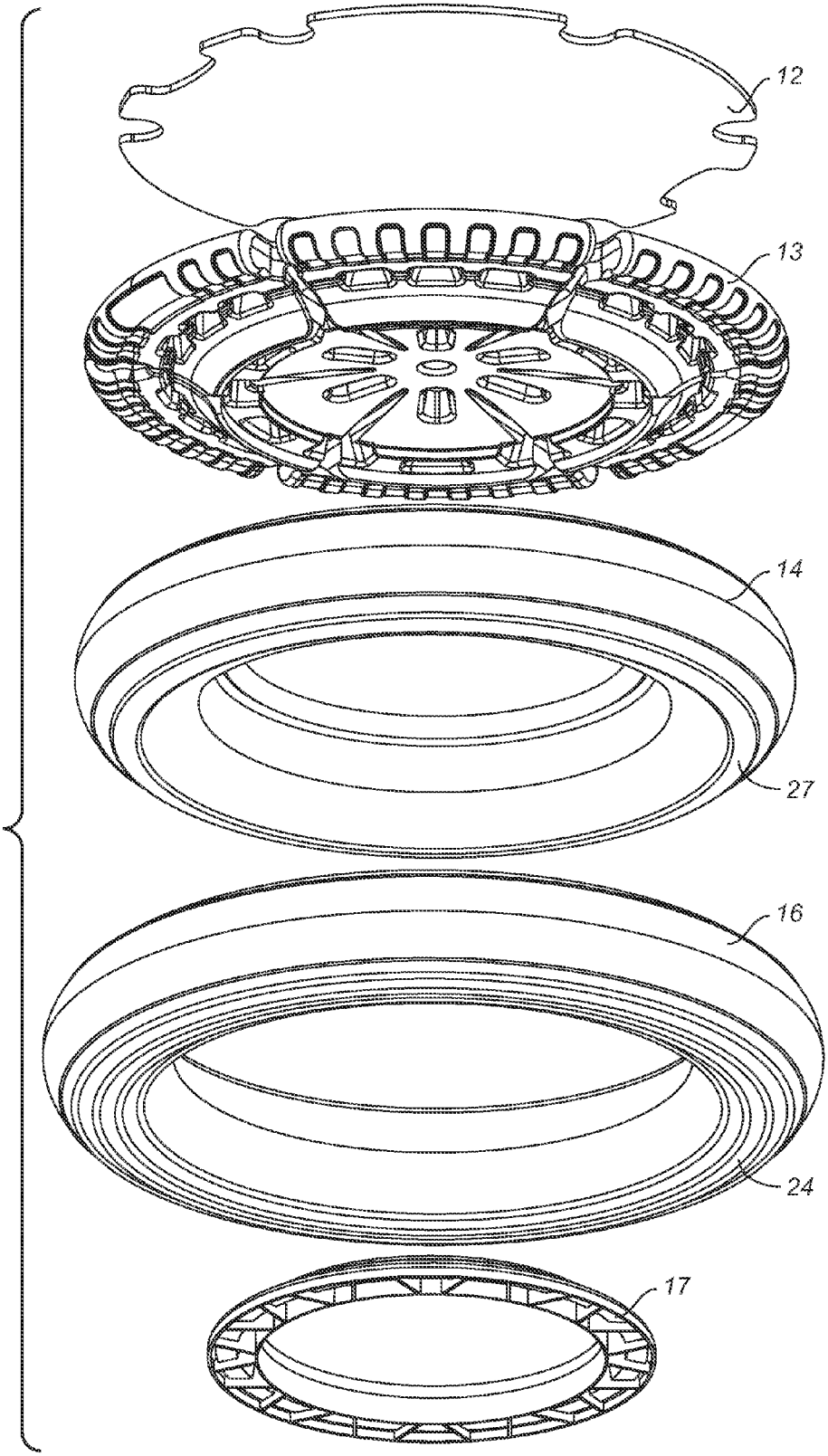
FIG. 7 illustrates an exploded view of the exercise device of FIG. 1.

FIG. 7 illustrates an exploded view of the exercise device of FIG. 1. Shown in FIG. 7 are a rigid platform 12, a platform support 13, an upper tubular support 14, a lower tubular support 16, a fastener ring 17, floor grip ridges 24, and a tongue and groove fastener 27.

In FIG. 7, the rigid platform 12, the platform support 13, the upper tubular support 14, the lower tubular support 16, and the fastener ring 17 may be conveniently assembled and disassembled by the corresponding fasteners for shipping, storage, and maintenance.

Figure 8:
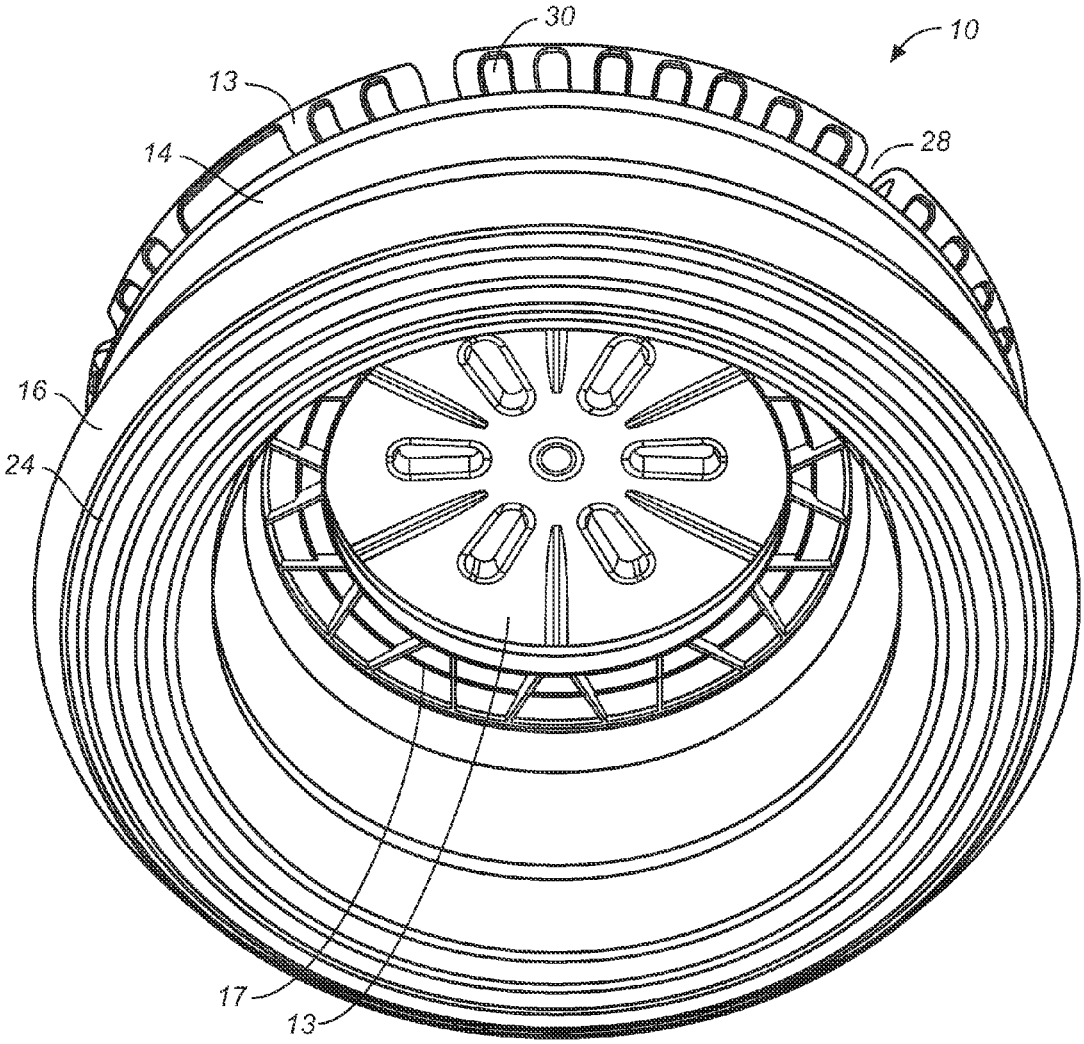
FIG. 8 illustrates a bottom perspective view of the exercise device of FIG. 1 with a fastener ring inside the upper tubular support.

FIG. 8 illustrates a bottom perspective view of the exercise device of FIG. 1 with a fastener ring inside the upper tubular support. Shown in FIG. 8 are a platform support 13, an upper tubular support 14, a lower tubular support 16, a fastener ring 17, floor grip ridges 24, accessory mounts 28, and air vents 30.

In FIG. 8, the fastener ring 17 clamps the upper tubular support 14 to the platform support 13 as described above with reference to FIG. 4.

Figure 9:
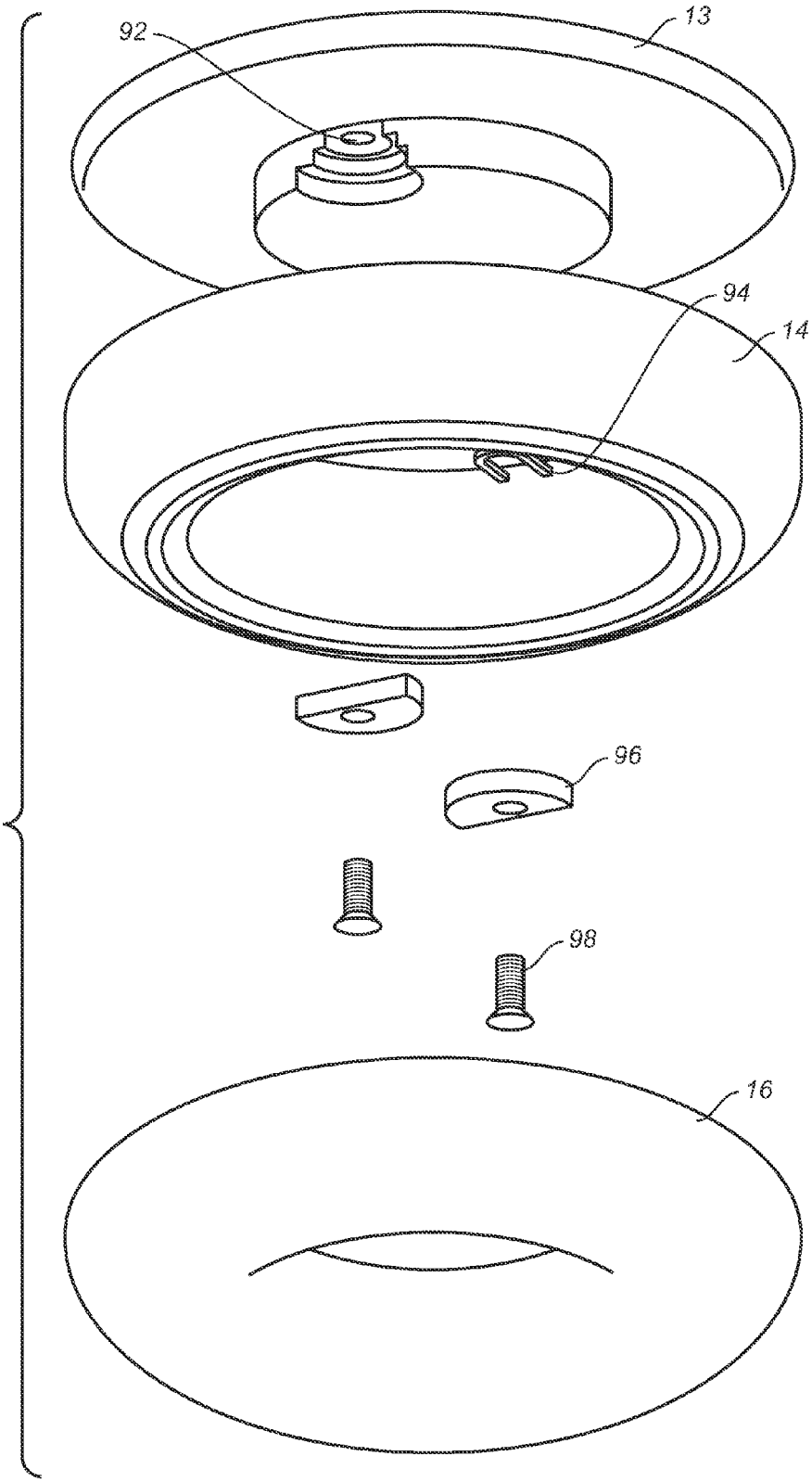
FIG. 9 illustrates an exploded view of the exercise device of FIG. 1 with the platform clamped to the upper tubular support by a fastener flange formed in the upper tubular support.

FIG. 9 illustrates an exploded view of the exercise device of FIG. 1 with the platform clamped to the upper tubular support by a fastener flange formed in the upper tubular support. Shown in FIG. 9 are a platform support 13, an upper tubular support 14, a lower tubular support 16, a flange recess 92, a fastener flange 94, a flange retainers 96, and flange bolts 98.

In FIG. 9, two or more of the fastener flanges 94 are formed in or affixed to the upper tubular support 14 according to well-known techniques. The platform support 13 includes the flange recess 92. The flange recess 92 includes a threaded hole that receives one of the flange bolts 98, a cutout that receives the fastener flange 94, and a cutout that receives one of the flange retainers 96. Two or more sets of the flange recesses 92, flange retainers 96, and flange bolts 98 are used to clamp the platform support 13 to the upper tubular support 14 through the fastener flanges 94.

Figure 10:
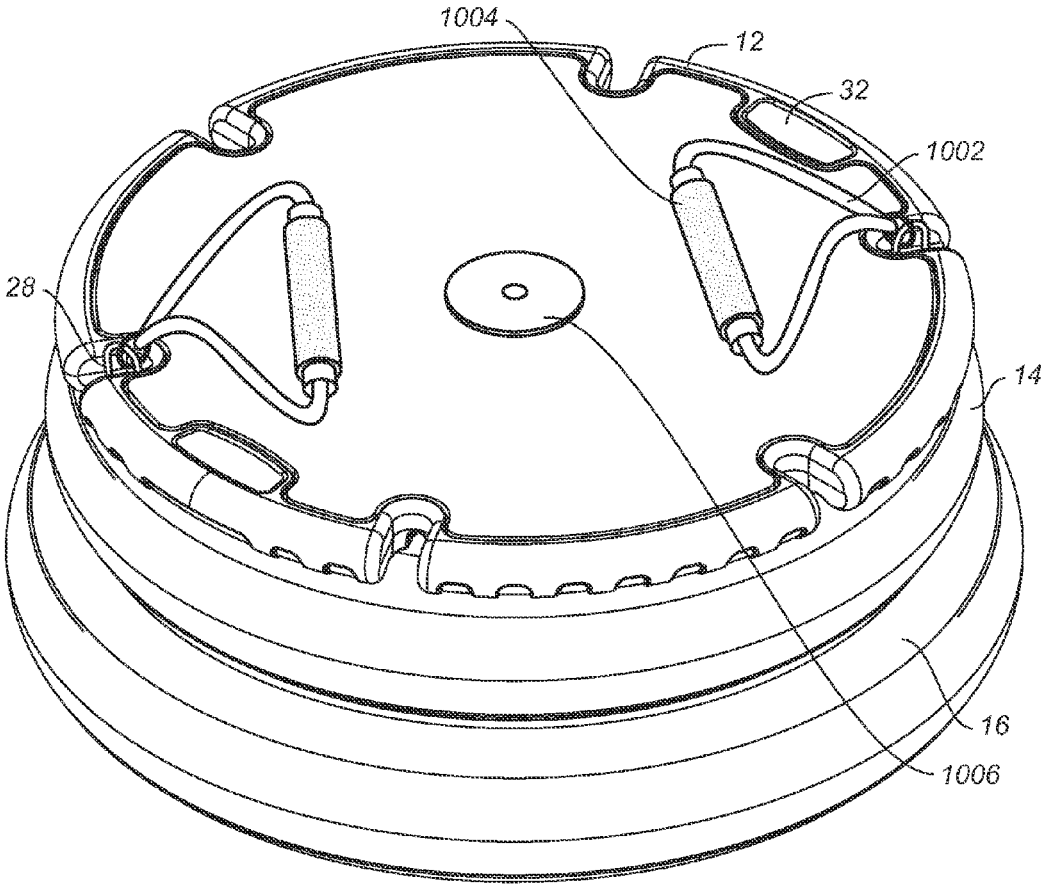
FIG. 10 illustrates a top view of the exercise device of FIG. 1 with retracting pull cables.

FIG. 10 illustrates a top view of the exercise device 10 of FIG. 1 with retracting pull cables. Shown in FIG. 10 are a rigid platform 12, an upper tubular support 14, a lower tubular support 16, accessory mounts 28, lift handles 32, retractable cables 1002, cable grips 1004, and a tension control 1006.

In FIG. 10, two of the accessory mounts 28 are used to attach the retractable cables 1002. In various embodiments, the retractable cables 1002 are elastic bands or inelastic flexible cables made according to well-known techniques and attached to or guided through the accessory mounts 28 in the rigid platform 12. The cable grips 1004 are preferably made of a plastic or rubber shaped to fit comfortably in the user's hands. In one embodiment, the rigid platform 12 includes recesses that receive the cable grips 1004 so that they may be stored flush with the top surface of the rigid platform 12 when the exercise device is used without the retractable cables 1002. In one embodiment, the tension control 1006 allows the user to adjust the resistance of the retractable cables 1002, for example, by adjusting a friction applied to one or more reels or other cable retracting mechanisms made according to well-known techniques and attached underneath the platform support 13 for winding and unwinding the retractable cables 1002.

Figure 11:
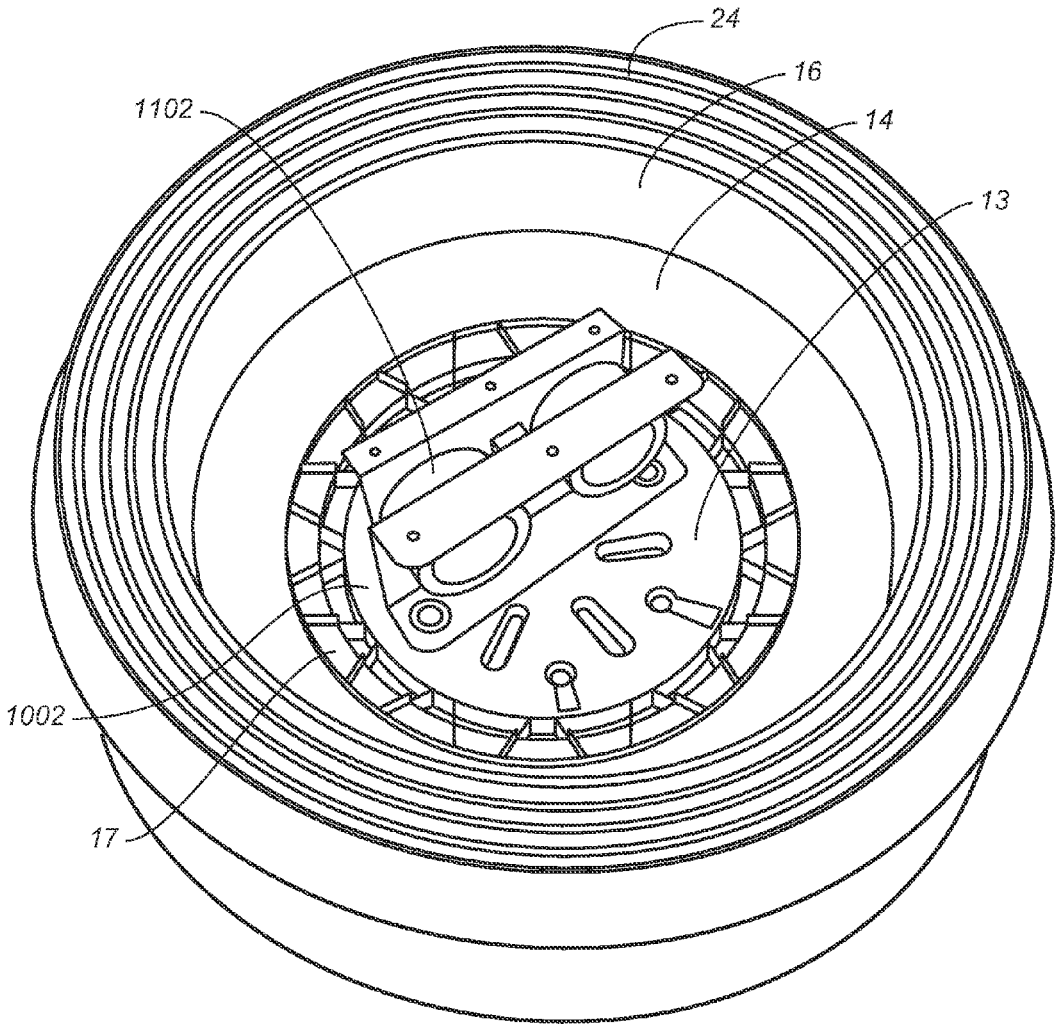
FIG. 11 illustrates a bottom view of the exercise device of FIG. 10 with a cable retracting mechanism.

FIG. 11 illustrates a bottom view of the exercise device of FIG. 10 with a cable retracting mechanism. Shown in FIG. 11 are a platform support 13, an upper tubular support 14, a lower tubular support 16, a fastener ring 17, floor grip ridges 24, a retractable cable 1002, and a cable retracting mechanism 1102.

In FIG. 11, the cable retracting mechanism 1102 is mounted under the platform support 13 to wind and unwind the retractable cables 1002. The cable retracting mechanism 1102 provides a continuous tension or resistance in response to both outward and inward movement of the retractable cables 1002 from the rigid platform 12.

Figure 12:
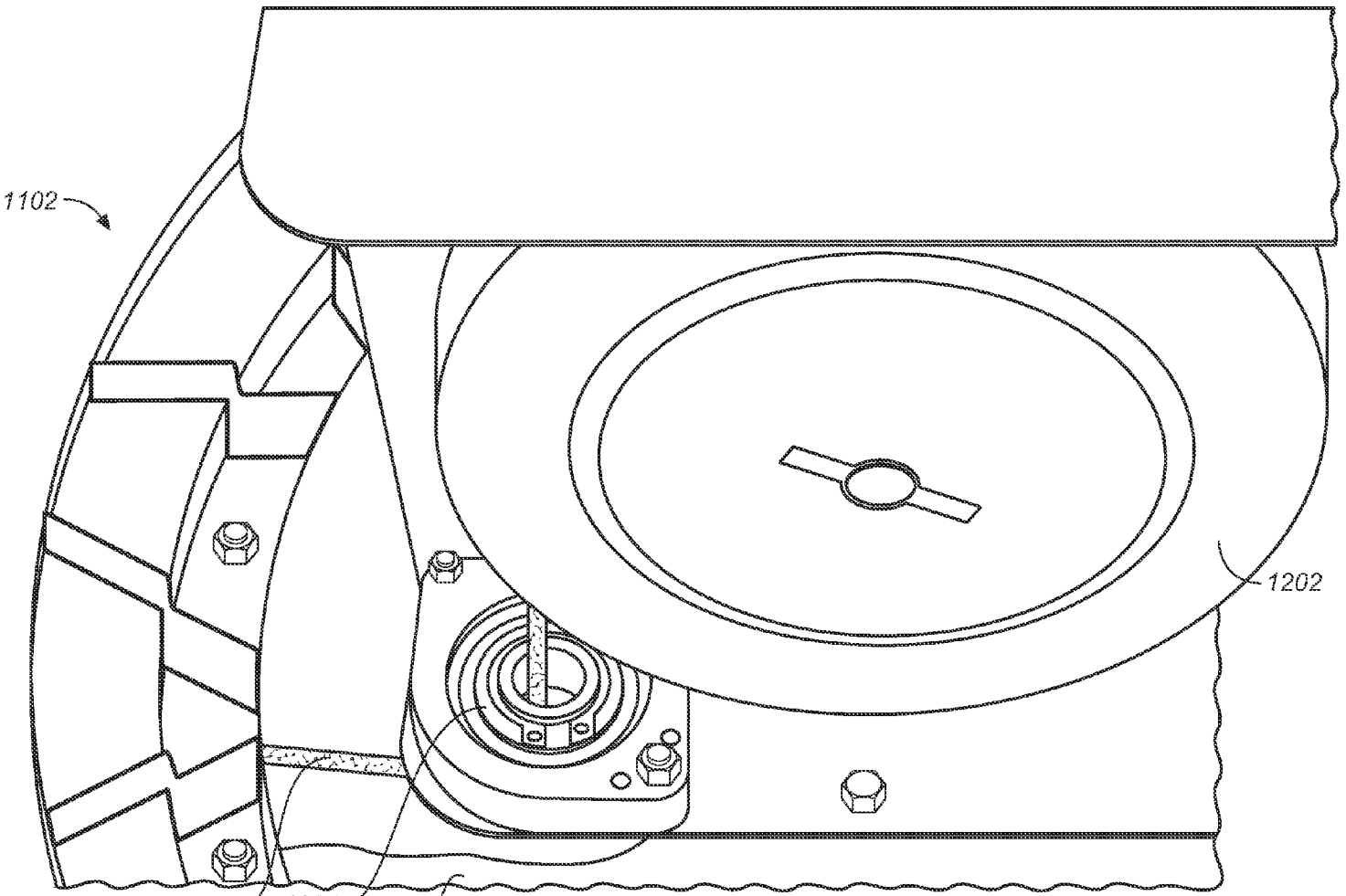
FIG. 12 illustrates a close-up view of the cable retracting mechanism of FIG. 11.

FIG. 12 illustrates a close-up view of the cable retracting mechanism 1102 of FIG. 11. Shown in FIG. 12 are a platform support 13, a retractable cable 1002, a cable reel 1202, and a cable guide 1204.

In FIG. 12, the retractable cable 1002 is routed under the platform support 13 through the cable guide 1204 onto the cable reel 1202. In one embodiment, the cable reel 1202 includes a spring that winds the retractable cable 1002 onto the cable reel 1202.

Figure 13:
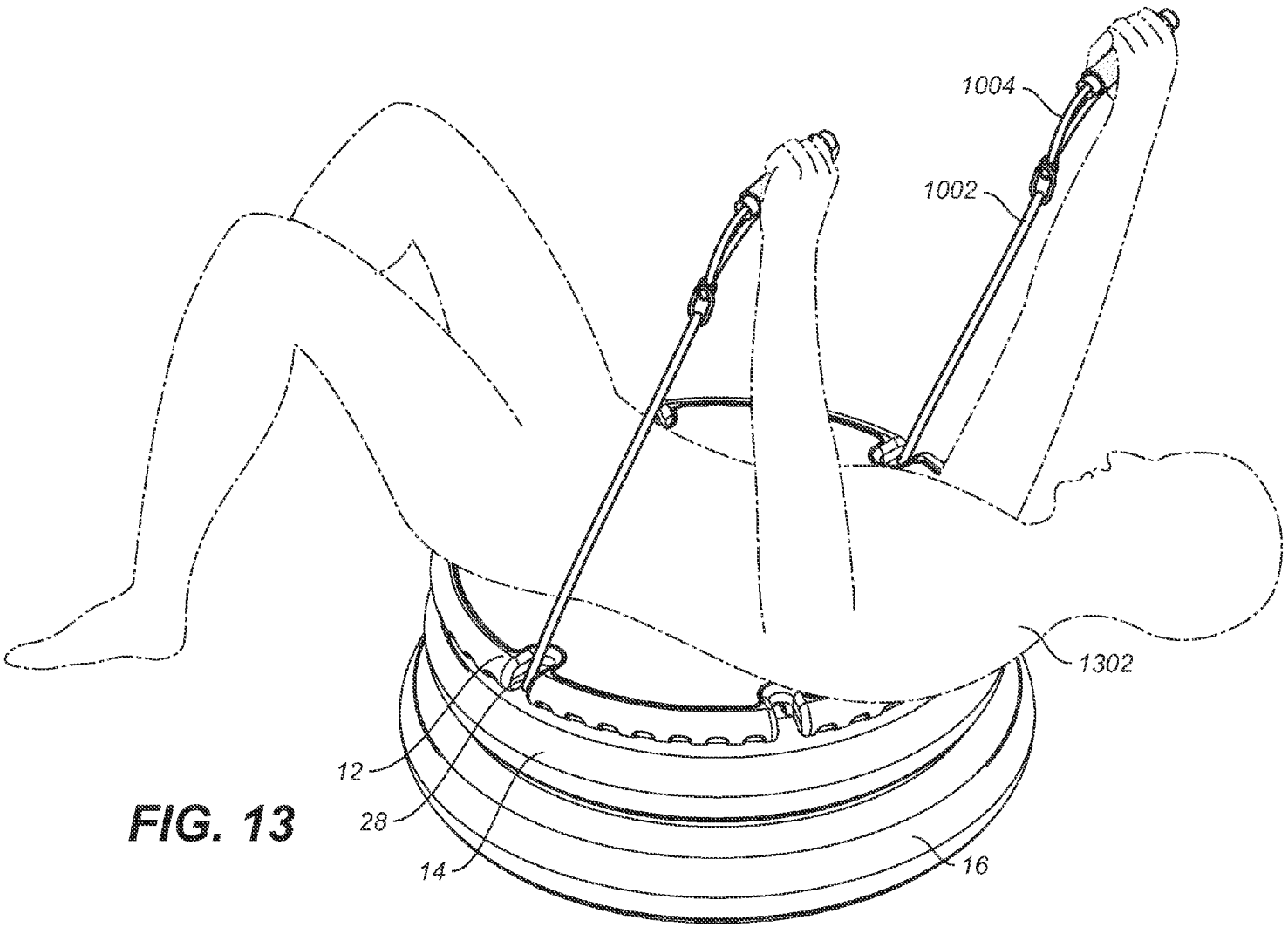
FIG. 13 illustrates a side view of the exercise device of FIG. 10 supporting the user's back.

FIG. 13 illustrates a side view of the exercise device of FIG. 10 supporting the user's back. Shown in FIG. 13 are a rigid platform 12, an upper tubular support 14, a lower tubular support 16, accessory mounts 28, retractable cables 1002, cable grips 1004, and a user 1302.

In FIG. 13, the user 1302 is supported from the back by the rigid platform 12 while pushing on the cable grips 1004 to extend the retractable cables 1002.

Figure 14:
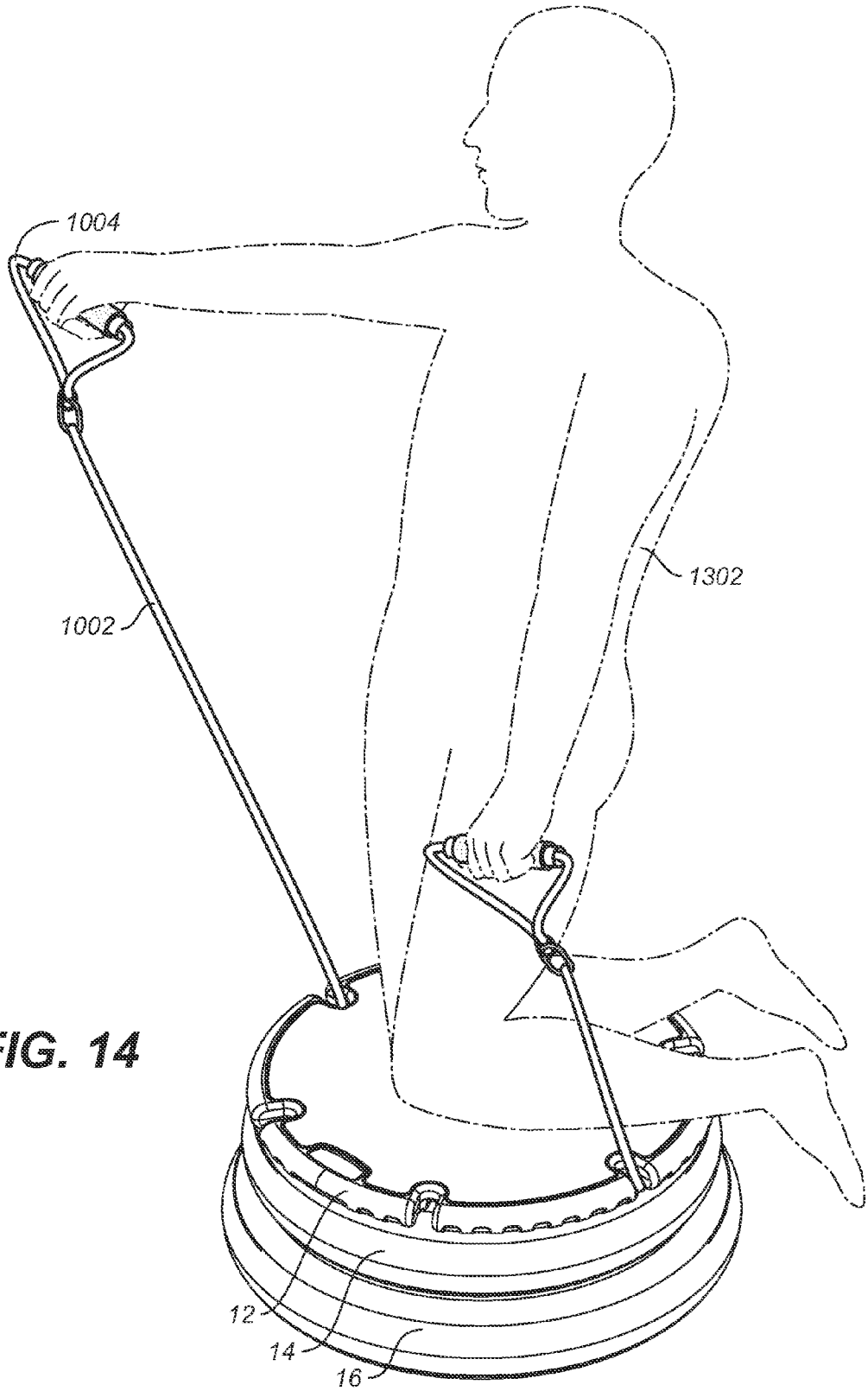
FIG. 14 illustrates a side view of the exercise device of FIG. 10 supporting the user's knees.

FIG. 14 illustrates a side view of the exercise device of FIG. 10 supporting the user's knees. Shown in FIG. 4 are a rigid platform 12, an upper tubular support 14, a lower tubular support 16, retractable cables 1002, cable grips 1004, and a user 1302.

In FIG. 14, the user 1302 is supported from the knees by the rigid platform 12 while lifting on the cable grips 1004 to extend the retractable cables 1002.

Figure 15:
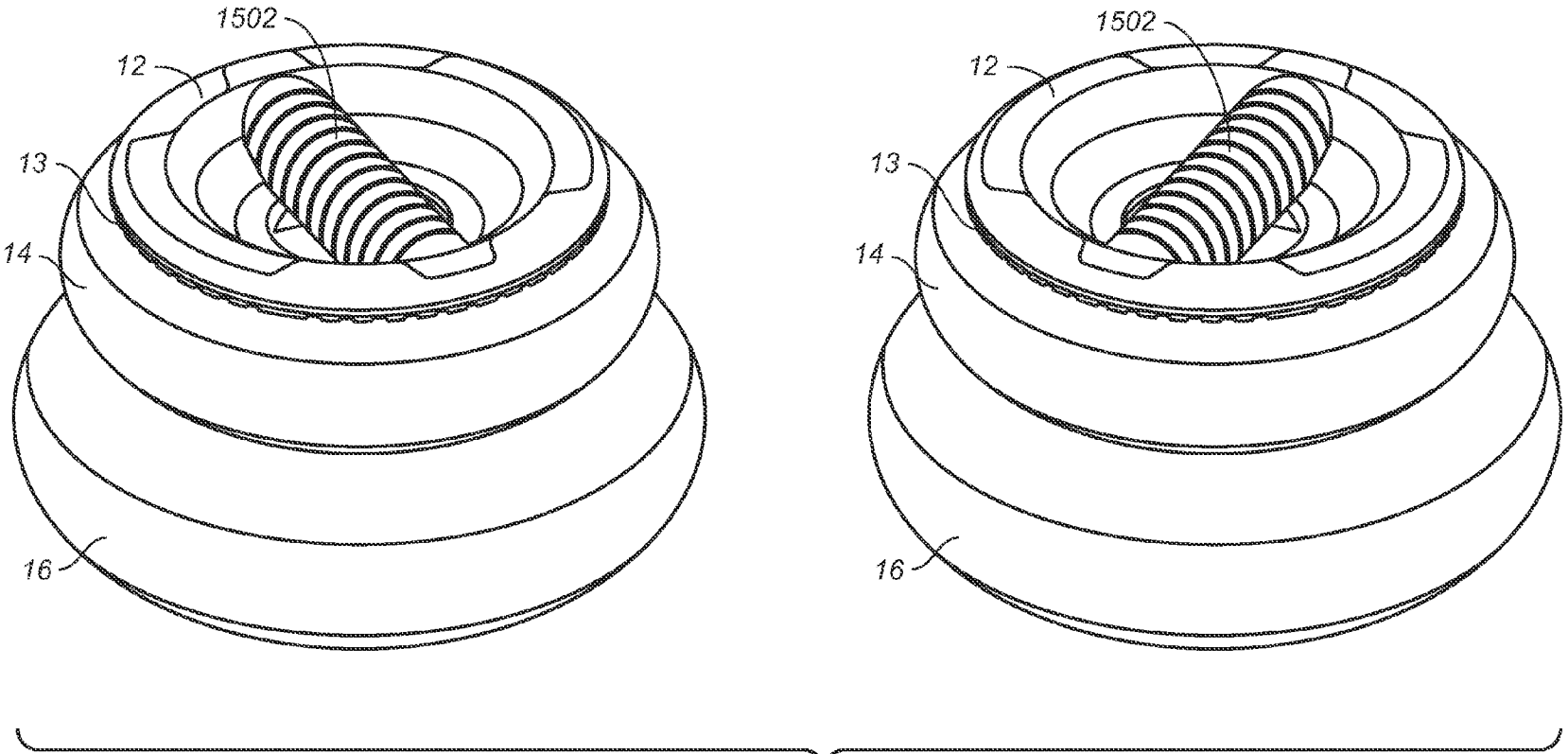
FIG. 15 illustrates a perspective view of a pair of exercise devices of FIG. 1 with centered hand grips.

FIG. 15 illustrates a perspective view of a pair of exercise devices 10 of FIG. 1 with centered hand grips. Shown in FIG. 15 are rigid platforms 12, platform supports 13, upper tubular supports 14, lower tubular supports 16, and hand grips 1502.

In FIG. 15, the hand grips 1502 are formed in each of the rigid platforms 12 for combined pushup exercises with proprioceptive training The platform supports 13 are open below the centered hand grips 1502 to allow the user's fingers to grasp around the centered hand grips 1502 below the platform supports 13 inside the central aperture in the center of the upper tubular supports 14 and the lower tubular supports 16. In various embodiments, the rigid platforms 12 are rotatable on the platform supports 13, for example, on ball bearings or other well-known mechanical couplings between the rigid platforms 12 and platform supports 13. In another embodiment, the rigid platforms 12 are fixed to or integral with the platform supports 13 so that they do not rotate relative to the upper tubular supports 14 and the lower tubular supports 16.

In one embodiment, a game includes a plurality of the exercise devices 10 of FIG. 1 adjacent to each other. Adjacent players supported by adjacent exercise devices 10 attempt to dislodge their fellow game players from their respective platforms 12 using their hands, padded staffs, or other equipment.

In various embodiments, the exercise device 10 has applications for aerobics, step aerobics, weight training with dumbbells, abdominal workouts, balance training, plyometric exercises, karate training, playing combat games and competitions, and muscle development with disabled children. Plyometric exercise is a training exercise designed to produce fast, powerful movements and to improve the functions of the nervous system, generally for the purpose of improving performance in sports.

In other embodiments, the rigid platform 12 and/or the platform support 13 include sensors and electronic interfaces for computer games, virtual environment simulations, measurement of body mass index, weight, motion, and so on. In one embodiment, one of the accessory mounts 28 is formed to hold a remote control for using the exercise device 10 with a video game or other electronic device.

In a further embodiment, the platform support 13 includes a vibrating mechanism and a switch according to well-known techniques so that the rigid platform 12 vibrates when switched on by the user for rehabilitation and training exercises.

The specific embodiments and applications thereof described above are for illustrative purposes only and do not preclude modifications and variations encompassed by the scope of the following claims.

What is claimed is:

1. An exercise apparatus comprising:

a substantially flat rigid platform for supporting body weight during exercise;

an inflatable tubular support defining a central aperture and including a flange projecting from the inflatable tubular support; and a fastener configured to clamp the flange to the rigid platform thereby coupling the flange to the platform wherein a vent is formed into the rigid platform that is configured to release air from the central aperture.

2. The exercise apparatus of claim 1 wherein the platform includes a hand grip to enable pushup exercises.

3. An exercise apparatus comprising:

a rigid platform defining a central opening and including a hand grip spanning the opening to enable pushup exercises;

an inflatable tubular support defining a central aperture and including a flange projecting from the inflatable tubular support; and a fastener configured to clamp the flange to the rigid platform thereby coupling the flange to the platform wherein the central aperture coincides with the opening in the rigid platform.

4. The exercise apparatus of claim 1 wherein the flange is an annular flange formed around a circumference of the inflatable tubular support.

5. The exercise apparatus of claim 4 wherein the fastener is a fastener ring configured to couple to the platform whereby the flange is clamped between the fastener ring and the platform.

6. An exercise apparatus comprising:

a substantially flat rigid platform for supporting body weight during exercise;

an inflatable tubular support defining a central aperture and including a flange projecting from the inflatable tubular support; and a fastener configured to clamp the flange to the rigid platform thereby coupling the flange to the platform wherein the flange projects toward the center of the exercise apparatus.

7. The exercise apparatus of claim 1 wherein the inflatable tubular support is a first inflatable tubular support and further comprising a second inflatable tubular support coupled to and configured to support the first inflatable tubular support.

8. An exercise apparatus comprising:

a substantially flat rigid platform for supporting body weight during exercise;

an inflatable tubular support defining a central aperture and including a flange projecting from the inflatable tubular support; and a fastener configured to clamp the flange to the rigid platform thereby coupling the flange to the platform wherein the inflatable tubular support is a first inflatable tubular support and further comprising a second inflatable tubular support coupled to and configured to support the first inflatable tubular support and wherein the first and second inflatable tubular supports are independently inflatable.

9. An exercise apparatus comprising:

a substantially flat rigid platform for supporting body weight during exercise;

a first inflatable support supporting the rigid platform and including a flange projecting from the first inflatable support;

a fastener clamping the flange to the rigid platform thereby coupling the first inflatable support to the rigid platform; and a second inflatable support supporting and coupled to the first inflatable support wherein the first inflatable support is inflatable to a first inflation pressure and the second inflatable support is inflatable to a second inflation pressure separately and independently from the first inflation pressure to effect a vertical instability and a horizontal instability of the rigid platform relative to a support surface under the second inflatable support.

10. The exercise apparatus of claim 9 wherein the rigid platform includes a hand grip to enable pushup exercises.

11. The exercise apparatus of claim 9 wherein the first and second inflatable supports are tubular.

12. An exercise apparatus comprising:

a substantially flat rigid platform for supporting body weight during exercise;

a first inflatable tubular support supporting the rigid platform and including a flange projecting from the first inflatable support;

a fastener clamping the flange to the rigid platform thereby coupling the first inflatable support to the rigid platform; and a second inflatable tubular support supporting and coupled to the first inflatable support wherein the second inflatable tubular support has a maximum outside diameter that is greater than a maximum outside diameter of the first inflatable tubular support.

13. The exercise apparatus of claim 11 wherein the first inflatable tubular support is nested into the second inflatable tubular support.

14. The exercise apparatus of claim 9 further comprising:

an accessory mount formed in the rigid platform;

a cable coupled to the accessory mount; and a hand grip coupled to an end of the cable.

15. An exercise apparatus comprising:

a substantially flat rigid platform for supporting body weight during exercise;

an inflatable tubular support defining a sealed internal cavity and further defining an exterior central aperture and including a flange projecting from the inflatable tubular support; and a fastener configured to clamp the flange to the rigid platform thereby coupling the flange to the platform.

* * * * *